US011540604B2

(12) United States Patent
Sabie

(10) Patent No.: US 11,540,604 B2
(45) Date of Patent: Jan. 3, 2023

(54) SPECTACLE CASE

(71) Applicant: Razvan Sabie, Bucharest (RO)

(72) Inventor: Razvan Sabie, Bucharest (RO)

( * ) Notice: Subject to any disclaimer, the term of this patent is extended or adjusted under 35 U.S.C. 154(b) by 0 days.

(21) Appl. No.: 16/623,914

(22) PCT Filed: Jun. 12, 2018

(86) PCT No.: PCT/RO2018/000009
§ 371 (c)(1),
(2) Date: Dec. 18, 2019

(87) PCT Pub. No.: WO2019/027338
PCT Pub. Date: Feb. 7, 2019

(65) Prior Publication Data

US 2020/0205535 A1 Jul. 2, 2020

(30) Foreign Application Priority Data

Jun. 23, 2017 (RO) ..... a 2017 00419

(51) Int. Cl.
*A45C 11/04* (2006.01)

(52) U.S. Cl.
CPC ..... *A45C 11/04* (2013.01)

(58) Field of Classification Search
CPC ..... A45C 11/04; A45C 11/046; A45C 11/06; A45C 11/08; A45C 11/005; A45C 2011/006; A45F 2200/0541; G02C 11/02
See application file for complete search history.

(56) References Cited

U.S. PATENT DOCUMENTS 579,656 A * 3/1897 Sanger ..... A45C 11/04 206/6
973,835 A * 10/1910 Willmott ..... A45C 11/04 206/6

(Continued)

FOREIGN PATENT DOCUMENTS

EP 2976961 A1 * 1/2016 ..... A45C 11/04
GB 420114 A * 8/1933 ..... A45C 11/04

(Continued)

OTHER PUBLICATIONS

International Search Report issued in connection with PCT/RO2018/000009 dated Feb. 21, 2019.

(Continued)

*Primary Examiner* — J. Gregory Pickett
*Assistant Examiner* — Abigail Elizabeth Guidry
(74) *Attorney, Agent, or Firm* — Dennemeyer & Associates, LLC

(57) ABSTRACT

The invention relates to a spectacle case for keeping and protecting the glasses and their lenses against pressure and abrasion. The spectacle case is made of a material body (1) with a front side (a) and a rectangular rear side (b) separated by means of an elastic rectangular central surface (c) and folding one towards the other one following folding lines (d) and (e) and the rear side (b) being provided on the outer edge side with a notch (f) curved towards the inside of the spectacle case and which is intended to come into contact with the nose pads of the bridge, thus fixing the spectacle case on the glasses, and the glasses' temples are folding on the outside of the spectacle case.

1 Claim, 7 Drawing Sheets

(56) References Cited

U.S. PATENT DOCUMENTS 1,699,712 A * 1/1929 Pratt ..... A45C 11/06 69/21
2,184,408 A * 12/1939 Bouchard ..... A45C 11/04 206/6
2,187,178 A * 1/1940 Schutz ..... A45C 11/04 206/6
2,288,255 A * 6/1942 Ross ..... A45C 13/34 206/6
2,332,266 A * 10/1943 Segal ..... A45C 11/043 206/6
2,464,149 A * 3/1949 Pearlstein ..... A45C 11/04 206/5
2,541,962 A * 2/1951 Healey ..... A45C 11/04 206/5
2,650,701 A * 9/1953 Parsell ..... A45C 11/043 206/5
2,762,500 A * 9/1956 Parsell ..... A45C 11/043 206/5
2,866,539 A * 12/1958 McCulloch ..... A45C 11/04 206/5
2,918,959 A * 12/1959 Bloch ..... A45C 11/04 206/5
3,144,127 A * 8/1964 Fogel ..... A45C 11/04 206/5
3,977,516 A * 8/1976 Tilve ..... A45C 11/04 206/5
4,000,810 A * 1/1977 Leblanc ..... A45C 11/04 206/5
4,984,682 A * 1/1991 Cummins ..... A45C 11/04 206/5
6,003,663 A * 12/1999 Newcomer ..... A45C 11/04 206/315.1
6,026,950 A * 2/2000 Wisniewski ..... A45C 11/04 206/6
6,053,309 A * 4/2000 Lin ..... A45C 11/04 206/6
6,431,351 B1 * 8/2002 Lin ..... A45C 11/04 206/214
6,772,878 B1 * 8/2004 Liebers ..... A45C 11/04 206/458
7,490,717 B2 * 2/2009 Chao ..... A47F 7/021 206/6
D612,148 S * 3/2010 Treece ..... D3/203.1
D877,505 S * 3/2020 Hanover ..... D3/265
D907,917 S * 1/2021 Lee ..... D3/265
2002/0043472 A1 * 4/2002 Guyot ..... A45C 11/04 206/5
2009/0057165 A1 * 3/2009 Park ..... A45C 11/04 206/6
2009/0188814 A1 * 7/2009 Huang ..... A45C 11/04 206/5
2017/0150793 A1 * 6/2017 Wu ..... A45C 13/005

FOREIGN PATENT DOCUMENTS

GB 420114 11/1934
GB 420114 A * 11/1934 ..... A45C 11/04
GB 440866 1/1936
GB 522357 A * 6/1940 ..... A45C 11/04
GB 537534 A * 6/1941 ..... A45C 11/24
RO 130959 B1 3/2016
RO 131607 1/2017
RO 132229 11/2017
WO 2016043612 A1 3/2016
WO WO-2016043612 A1 * 3/2016 ..... A45C 11/04
WO 2018106136 6/2018

OTHER PUBLICATIONS

International Written Opinion issued in connection with PCT/RO2018/000009 dated Feb. 18, 2019.
National Search Report issued in connection with RO132229 dated Jun. 7, 2018.

* cited by examiner

SPECTACLE CASE

CROSS-REFERENCE TO RELATED APPLICATIONS

This is a 35 U.S.C. 371 National Stage Patent Application of International Application No. PCT/RO2018/000009, filed Jun. 12, 2018, which claims priority to Romanian application A/00419, filed Jun. 23, 2017, each of which is hereby incorporated by reference in its entirety.

The invention relates to an attachable spectacle case for spectacles or sun glasses.

Spectacle cases are often designed to receive the entire rim of the glasses. Although, on the one hand, framing the entire rim by the spectacle case provides a good protection for the glasses, on the other hand, their portability is limited.

Ordinary glasses rims, which frame the entire rim, are generally massive, made of non-deformable materials, making it difficult to carry in clothing. For this reason, most people do not keep their glasses in such spectacle cases, but carry them in their pockets, such as the breast pocket, or just leave them in handy places when they are not needed.

In the most common cases, glasses are lost, their lenses may be scratched or may be covered by dust when left uncovered, or glasses can easily break when they are dropped, so there is a need for making a simple, easy, flexible and with a reduced gauge.

Several types of spectacle cases are known which have advantages and disadvantages and which are disclosed in OSIM Romania patent applications A2014 00663 and PCT/RO2015/000021 incorporated by reference herein, as well as in patents and patent applications EP2976961A1, JP4011034B2, U.S. Pat. No. 4,290,522, WO2011095864A2.

The disadvantage of the solution in patent applications OSIM Romania A2014 00663 and PCT/RO2015/000021 consists in the fact that the described spectacle case can only be used for spectacle-like types of sizes, due to the fact that the clasp of the spectacle case attaches to the rim of the bridge of the glasses and cannot be attached to glasses with similar bridges, which limits the applicability of the solution. The purpose of the present invention is to overcome this disadvantage in that a spectacle case fabricated according to the invention can be used for relatively different size glasses, with different bridges, thus giving it greater applicability.

The spectacle case according to the invention is made of a body of sufficiently rigid material such as natural or synthetic leather or plastic, whether or not combined with textile materials, the body of material having a front face and a rectangular rear face, separated by means of a central, rectangular, elastic surface and folding to one another by folding lines, the rear side being provided with a groove which is folded over the nose pads of the glasses, coming in contact with them and having the role to fix the glasses inside the spectacle case.

The solution according to the present invention has the advantage over other inventions that it is simpler, more convenient and easier to use. Also, another main advantage is that the same spectacle case can be used for fairly different types of spectacles.

According to the invention, the spectacle case also has the advantage of a reduced gauge, which can be stored in any pocket, neck or hip in any kind of bag and chair in a hard case without uncomfortable protection lenses of glasses against touch, pressure and abrasion. Also, another advantage is that it can be produced easily and cheaply.

BRIEF DESCRIPTION OF THE DRAWINGS

Here are some examples of embodiments of the invention, with reference to FIGS. 1-20, which are.

DETAILED DESCRIPTION OF THE DRAWINGS

Figure 1:
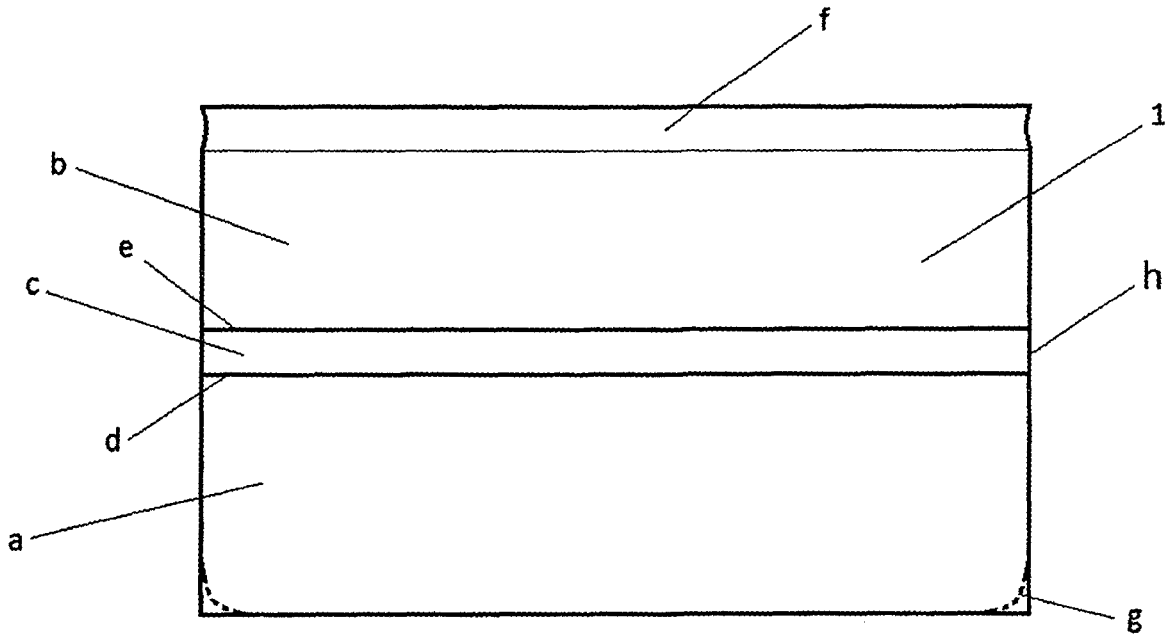
FIG. 1, a view of the body of the material.
Figure 2:
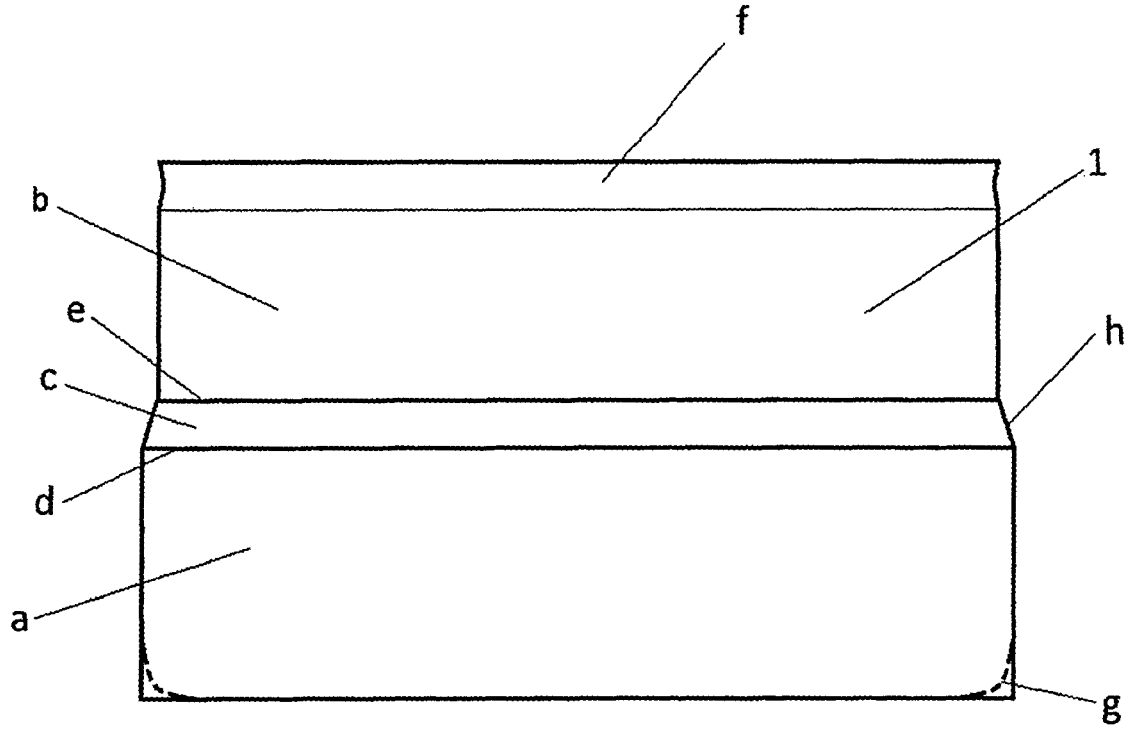
FIG. 2, a depicted view of the body having a rear side smaller than the front side.

The spectacle case according to the invention, as depicted horizontally in FIG. 1, is made of a material body 1, which may be a material of quite high stiffness but also elastic, returning to the initial shape (if bent) after bending. The material body 1 has a front side and rectangular rear side b, which may have rounded corners g, separated by a rectangular central surface c, sides a and b folding one along the other along the folding lines d and e. The rectangular central surface c must have a width sufficiently large for the glasses to enter the spectacle case properly. In the case of less rigid material, the folding lines d and e, as well as the edges of sides a and b, can be stiffened by hems and stitches. The central surface c is entirely elastic or only its lateral parts h are elastic. The rear side b is provided in the outer side with a notch f, curved towards the inside of the spectacle case. This notch f is intended to come in contact with the nose pads (pills) and thus fix the spectacle case on the glasses. In order to fit more than one type of spectacle size, the rear side b may have a slightly smaller surface than the anterior side of a, so that it can easily enter between the glasses' temples—FIG. 2.

Figure 3:
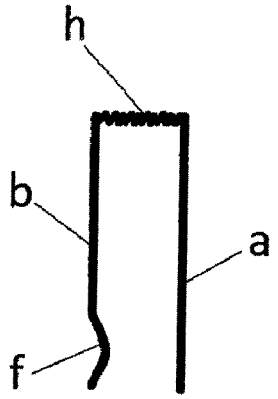
FIG. 3, lateral view of the spectacle case in the constructive embodiment with a transverse edge in the form of a helical spring FIG. 4, view of how the spectacle case attaches to the glasses.
Figure 4:
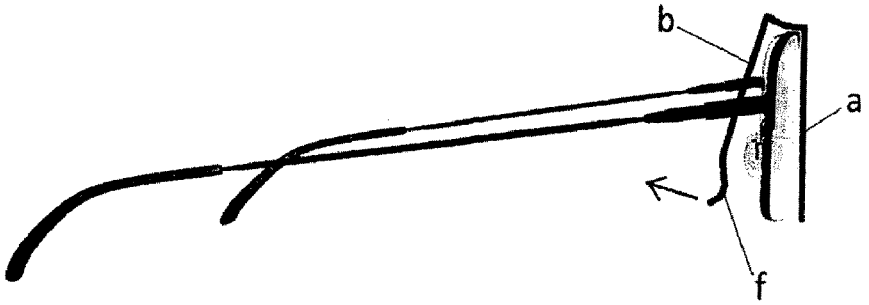

FIG. 3 shows, from the side, the spectacle case in the position of use and the manner in which the notch f is profiled. In order for the spectacle to easily return to its form of use and at the same time to stand firmly on the glasses, the central surface c is entirely made of an elastic material or only the sides h of the central surface c can be made of the spiral springs, or other elastic properties that return to their original shape after they are curved. The way of using the spectacle case is as follows: unwrap the spectacle case, place the glasses with the unfolded temples with the bridge to the rear side b—FIG. 4, then release the face so that the notch f comes in contact with the bottom of the nose pads, thus fixing the spectacle case on the glasses.

Figure 5:
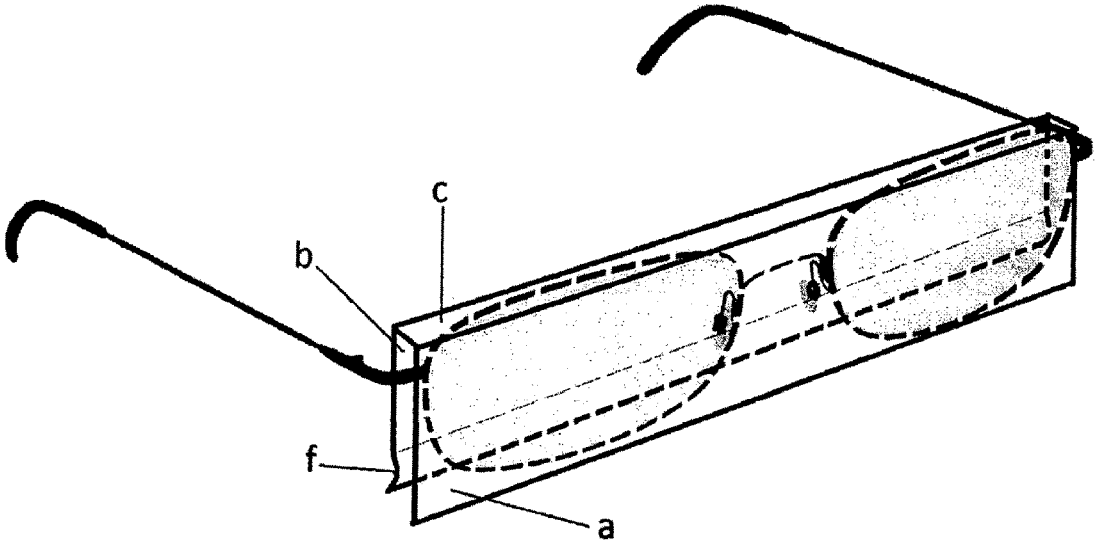
FIG. 5, an overview of the spectacle case attached to the glasses.

FIG. 5 shows a spectacle case attached to the glasses.

Figure 6:
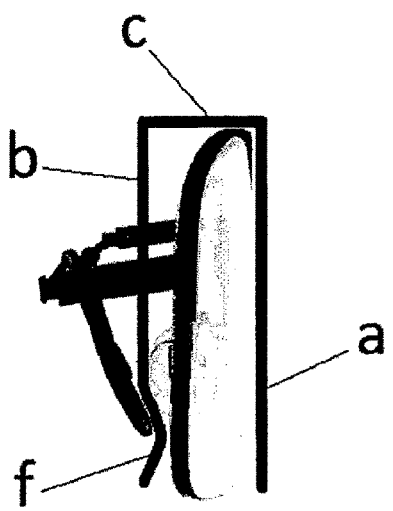
FIG. 6, profile view of the spectacle case attached to the glasses.

FIG. 6 shows a lateral view of the attached spectacle case in the final position, where the inner profile of the notch f is in contact with the nose pads of the bridge to fix the spectacle case on the glasses, the glasses being with the folded temples.

Figure 7:
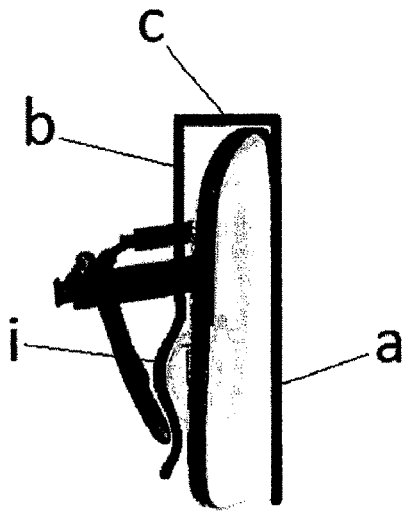
FIG. 7 is a perspective view of a narrower version of the spectacle case attached to the glasses.
Figure 8:
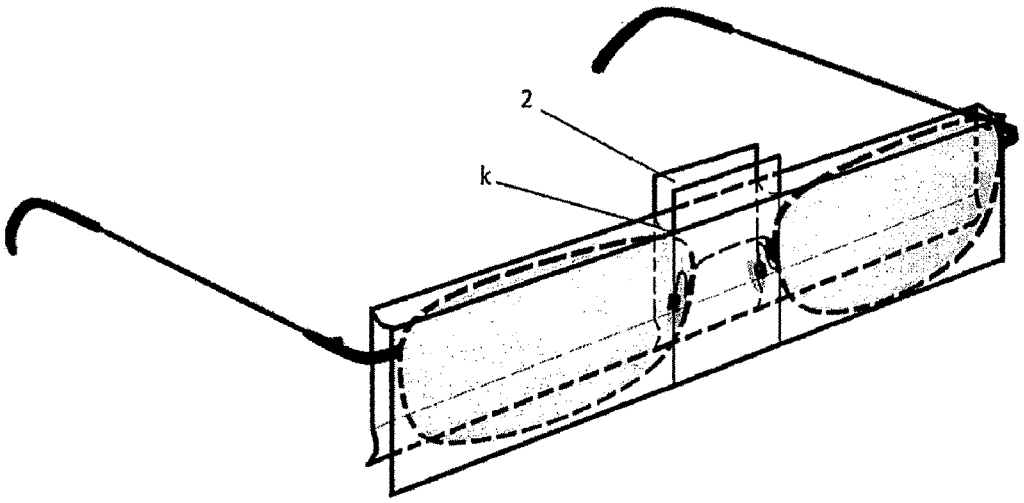
FIG. 8, overview of the version with clasp.
Figure 10:
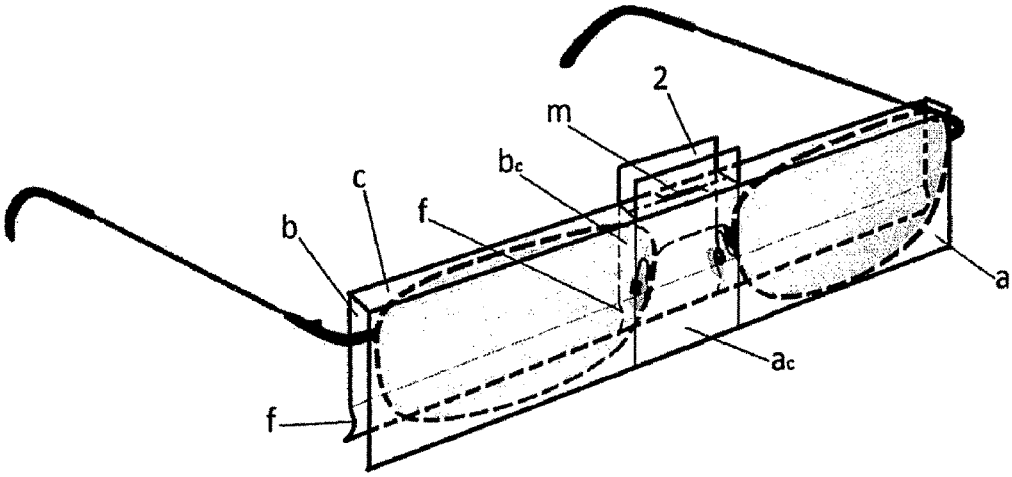
FIG. 10, overview of the curved clasp version.
Figure 19:
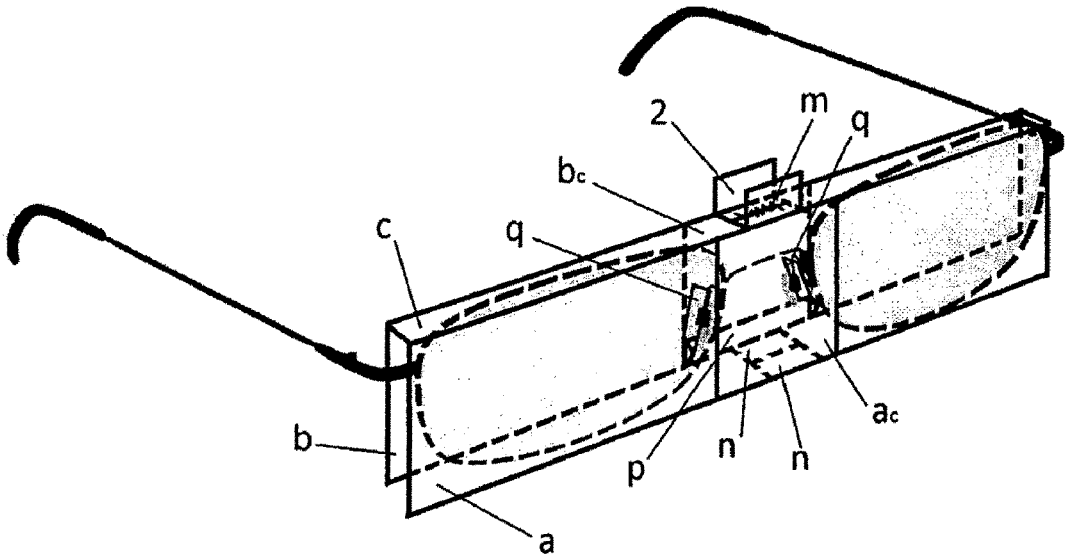

FIG. 7 shows a narrower shape of the spectacle case, and the rear side b has a wavy surface, the outline of which contacts a longer length with the nose pads. For easier attachment of the spectacle case to the glasses, it can be provided with a central clasp 2—FIG. 8. The central clasp 2 consists of two sides, the anterior needle side and the rear side bc, which are integral with the sides a and b respectively, of the body 1. Side ac and bc are shown in FIGS. 10 and 19. The central clasp 2 is provided in its lateral parts which are at the surface of the body 1 with helical springs k or other similar resilient materials. The clasp 2 is disposed in the central region of the spectacle case, it is made of a rigid material, it has on the rear side bc the same notch f and has a width greater than the distance between the nose pads (pills) so that the bridge is contained inside the clasp and its nose pads come in contact with the notch f so that the clasp 2 and, implicitly, the spectacle case is attached to the glasses.

Figure 9:
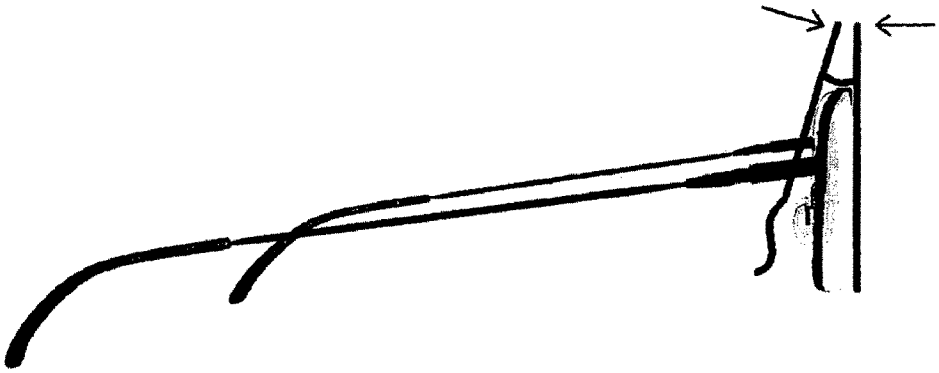
FIG. 9, a view of how the spectacle case with clasp is attached to the glasses.
Figure 11:
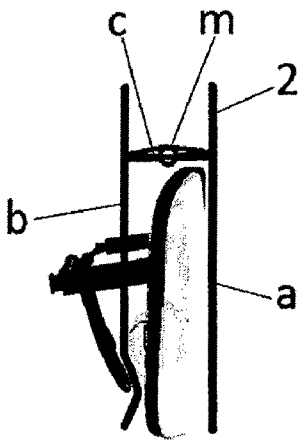
FIG. 11 is a cross-sectional view of the curved clasp version.
Figure 12:
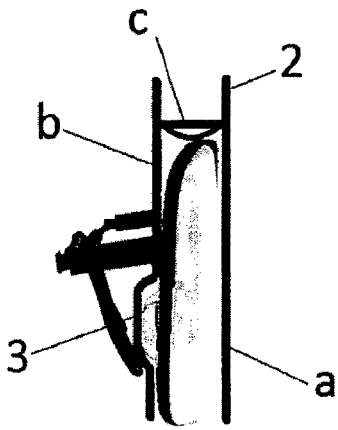
FIG. 12 is a cross-sectional view of the curved clasp version of the rim, provided with protection surfaces the lower part of the rim of the glasses.

The manner in which this constructive version of the spectacle case is attached is shown in FIG. 9. The clasp 2 may have various constructional shapes, and one of the most common forms of the clasp is the single helical spring m—FIG. 10 and FIG. 11. For the center clasp 2 may also have a constructional variant in which, instead of the notch f, the rear side of the clasp is provided with a profiled cavity 3 having a width greater than the usual distance between the nose pads, cavity shape 3 comprising entirely the nose pads of the bridge FIG. 12, thus fixing the spectacle case on the glasses.

Figure 13:
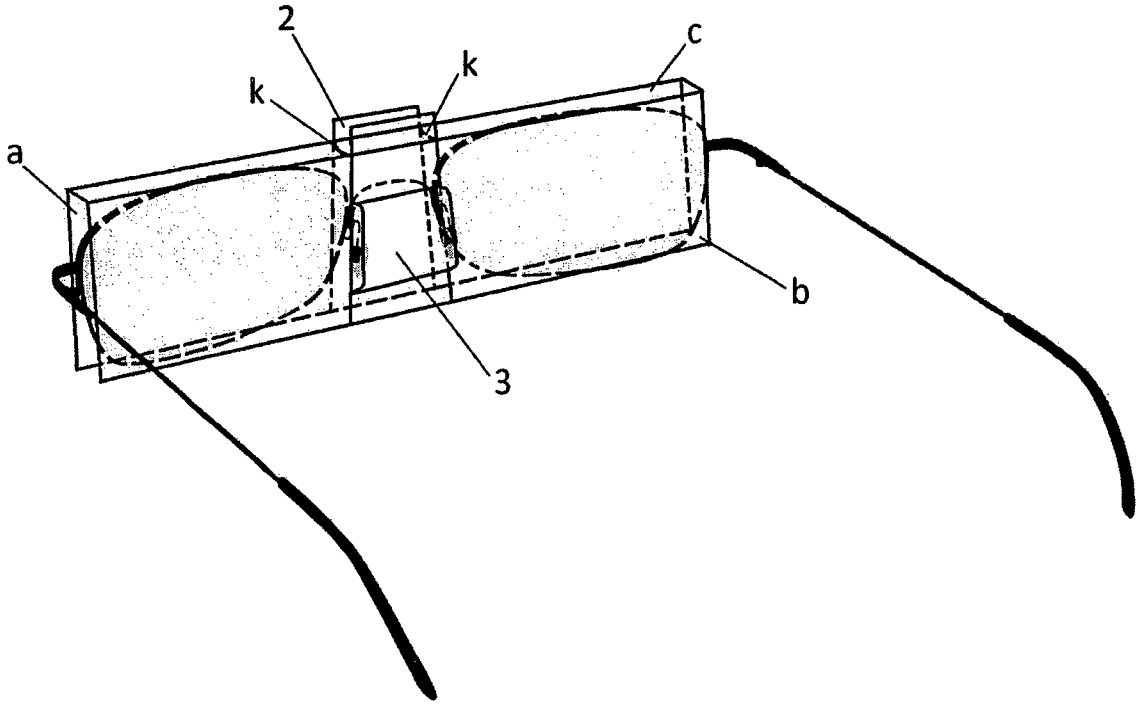
FIG. 13 is a cross-sectional view of a profiled cavity clasp version.
Figure 14:
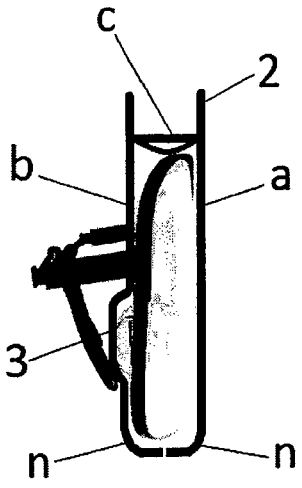
FIG. 14 is a cross-sectional view of the clasp version with the lower edges in contact.
Figure 15:
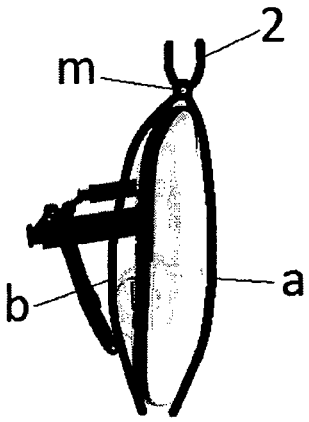
FIG. 15, profile view of the clasp version and curved surfaces

FIG. 13 is an overall view of this embodiment of the spectacle case with central clasp with profiled cavity 3. In order to better protect the lower portion of the glasses, the anterior side a and rear side b are provided with inwardly curved surfaces n, and these can even come in contact—FIG. 14.

Figure 16:
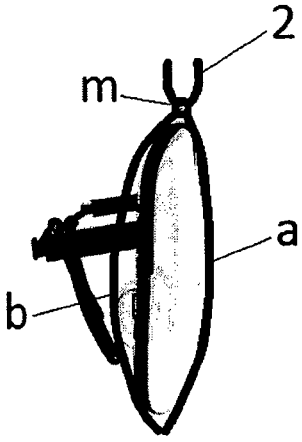
FIG. 16, profile view of the clasp version and curved surfaces that come in contact with each another

Another simple constructive version of the spectacle case is that in which the surface c is missing and the two sides a and b are respectively curved and the rear side b is curved so as to come into contact with the lower part of the nose pads of the bridge, thus fastening the spectacle case on the glasses. By prolonging the sides a and b so that they come in contact with one another, the constructive version of the spectacle case that fully protects the bottom of the glasses is obtained —FIG. 16

Figure 17:
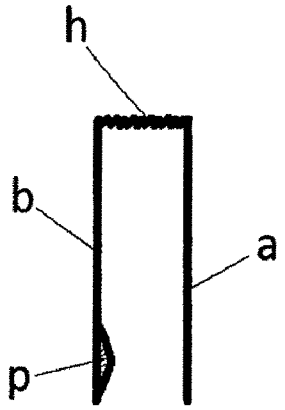
FIG. 17 is a perspective view of the spectacle case provided with a pawl FIG. 18, an overall view of the spectacle case provided with a pawl FIG. 19, a general view of the clasp version provided with horizontal and oblique pawls, as well as contact surfaces between the sides
Figure 18:
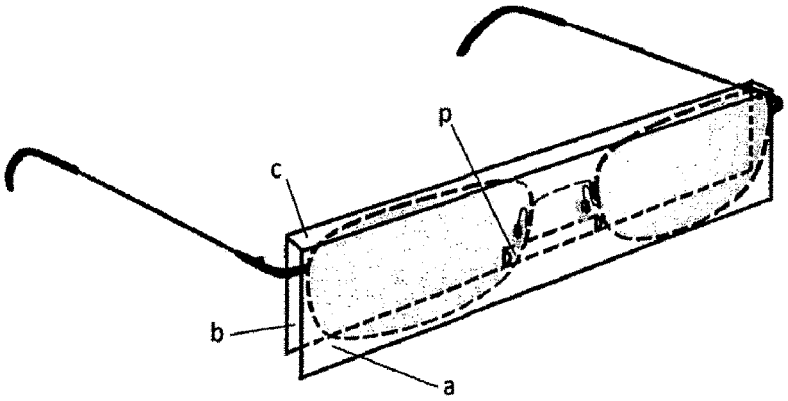

It is possible to make a very simple version of the spectacle case, the sides a and b being flat and the inner part of the side b is provided with a horizontal pawl p for the nose pads of the bridge—FIG. 17 and FIG. 18.

The same solution can be also applied to the clasp variant, in which case the ac and bc sides are flat and the bc side is provided internally with the pawl p, which has the function of fixing the nose pads—FIG. 19.

Figure 20:
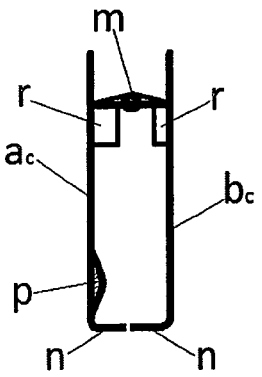
FIG. 20 is a perspective view of a clasp provided with inner spacers

For a better fixation of the nose pads, the inner face of the spectacle case or the bc side of the clasp can be additionally provided with two additional pawls q, which are in the form of rectangular surfaces disposed perpendicularly to the side b or the side bc, oriented vertically or obliquely with the pawl p, and the pawls q are intended not to let the nose pads move sideways. In order to achieve a firm attachment of the spectacle case, the inner sides a and b of the spectacle case or ac and bc of the clasp are provided in the central area with spacers r which are designed to form a space between them to accommodate several size types of bridges, but also to limit their movement inside the spectacle case—FIG. 20.

The invention claimed is:

1. A spectacle case for holding a pair of glasses having a pair of nose pads and temples, the case made of a material body having a rigid rectangular front side (a) and rear side (b) having rounded corners (g), the rectangular front side (a) and the rear side (b) are attached to a flexible rectangular central surface (c) on opposite sides at a pair of folding lines (d) and (e) to enable the front side (a) and the rear side (b) to fold onto one another along the folding lines (d) and (e), wherein the rear side (b) is provided with a notch (f) extending the length of the rear side (b) and curved inwardly on the rear side (b) to come into contact with the pair of nose pads on the glasses, and where the notch (f) fastens the spectacle case on the glasses, where the flexible rectangular central surface (c) either:

includes helical springs or sections of elastic material disposed on opposite sides (h) of the rectangular central surface, or is entirely made of an elastic material that comes back to an original shape of the rectangular central surface after being curved, and the temples are folded out of the spectacle case.

* * * * *